United States Patent [19]

Przepiora et al.

[11] Patent Number: 4,561,542

[45] Date of Patent: Dec. 31, 1985

[54] ELECTRIC LAMP PACKAGE AND CARTON THEREFOR

[75] Inventors: Edward Przepiora, Pierrefonds, Canada; Gerald T. Lombardi, Florida, N.Y.

[73] Assignee: North American Philips Corporation, New York, N.Y.

[21] Appl. No.: 674,360

[22] Filed: Nov. 21, 1984

Related U.S. Application Data

[63] Continuation of Ser. No. 442,072, Nov. 16, 1982, abandoned.

[51] Int. Cl.[4] ..... B65D 5/10

[52] U.S. Cl. ..... 206/418; 206/45.14; 206/170; 229/39 B; 229/41 C

[58] Field of Search ..... 206/45.14, 45.19, 68, 206/418, 419, 420, 421; 229/39 B, 39 R, 41 B, 41 C, 41 D, 41 R

[56] References Cited

U.S. PATENT DOCUMENTS

| | | | |
|---|---|---|---|
| 4,099,612 | 7/1978 | Hanson | 206/418 |
| 4,129,248 | 12/1978 | Casuitt | 229/41 B |
| 4,313,556 | 2/1980 | Boyle et al. | 229/41 B |

FOREIGN PATENT DOCUMENTS

| | | | |
|---|---|---|---|
| 0024596 | of 1912 | United Kingdom | 229/39 B |
| 1174044 | 12/1969 | United Kingdom | 206/45.19 |
| 1309778 | 3/1973 | United Kingdom | 206/45.19 |
| 1379751 | 1/1975 | United Kingdom | 206/45.19 |

*Primary Examiner*—William T. Dixson, Jr.
*Assistant Examiner*—Jimmy G. Foster

[57] ABSTRACT

A fragile article such as an electric lamp having a glass bulb of spherical, paraboloidal or general pear-shaped configuration is protectively packaged by inserting it into snug slip-fitted relationship with an open-ended hexagonal sleeve-like carton of boxboard or other suitable packaging material. Parts of opposing walls of the carton are cut, scored and interconnected to provide a foldable flap assembly that is automatically actuated when the carton is expanded from collapsed condition and is then converted in "snap-like fashion" into a laterally-extending platform that locks the carton in its fully-erected tubular configuration. The platform is provided with a suitable aperture which frictionally grips the basal end portion of the inserted lamp and thus holds the lamp in loaded position within the carton. The unique snap-locking flap assembly accordingly not only serves as an integral article-retaining and bracing means for the carton which greatly facilitates the setting-up and carton-loading operations but provides window openings which attractively display the packaged lamp.

11 Claims, 11 Drawing Figures

ELECTRIC LAMP PACKAGE AND CARTON THEREFOR

This is a continuation of application Ser. No. 442,072, filed Nov. 16, 1982, and now abandoned.

BACKGROUND OF THE INVENTION

This invention relates to the packaging art and has particular reference to an improved carton for packaging fragile articles, such as electric lamps, and to the improved package which results from the use of such a carton.

In order to protect the glass envelopes of electric lamps from breakage during shipment and when being displayed and handled at the retail level, the lamps are customarily placed in a suitable wrapper or carton at the lamp factory. Due to the large numbers of electric lamps that are manufactured and marketed each year, the cost of packaging material is an important factor in the lamp industry. To minimize such costs, the electric lamps are packaged by slipping them into wrappers or cartons of open-ended tubular configuration that are made of suitable packaging material such as paperboard. Further reductions in material cost were achieved in the prior art by making the tubular containers of hexagonal rather than square cross-section and providing them with inturned article-retaining or rigidifying flaps. A fiberboard container of hexagonal configuration having a series of inturned panels that are formed from parts of the container walls and thus provide means for rigidifying the container and supporting an inserted article such as a light bulb is disclosed in U.S. Pat. No. 3,750,934 issued Aug. 7, 1973 to Clinage. An open-ended carton of square cross-section for packaging a parabolic lamp bulb and having a pair of yoke-like platforms formed by inturned against flaps that are cut from the carton walls and support and display the inserted lamp is disclosed in U.S. Pat. No. 3,734,397 issued May 22, 1973 to Cote.

A dispensing-type carton that is of octagonal configuration and has flap elements which provide a snap-action self-locking end closure for the carton is disclosed in U.S. Pat. No. 3,526,352 issued Sept. 1, 1970 to Swett. A self-locking paperboard container comprising a tubular body portion of octagonal configuration having a cap member of the same configuration is disclosed in U.S. Pat. No. 4,134,531 issued Jan. 16, 1979 to Martinez et al.

While the prior art containers and cartons were generally satisfactory from the standpoint of providing integral locking or rigidifying means which retained the loaded lamp or other article within the carton and provided display openings, they were so constructed that they were difficult to set up for loading and thus did not meet the stringent labor-efficiency standards required for the mass-production of electric lamps and similar articles. The present invention solves this problem by providing a carton which can be easily and quickly set up for loading and then automatically locked in such condition by an integral flap assembly that not only conserves packaging material but attractively exposes selected portions of the packaged lamp (or other article) to the view of perspective purchasers.

In accordance with a preferred embodiment, the foregoing advantages are obtained by fabricating the carton from a single piece of boxboard or the like that is cut, scored and glued together in such a fashion that the carton collapses flat for bulk shipment to the lamp factory and, when expanded, forms an open-ended hexagonal sleeve that is automatically locked in such configuration by an internal platform that is actuated and snapped into place by the pivotal forces created during the setting-up operation. This very advantageous automatic self-locking feature is achieved by utilizing parts of opposing walls of the carton to form the platform and by so gluing and scoring such parts that they comprise a foldable integral flap assembly that snapes into "platform-forming" position by means of a toggle-like joint just as the carton reaches its fully-expanded tubular configuration. The various panels which comprise the foldable flap assembly are so oriented and shaped that they leave window-openings in the sides of the erected carton through which the electric lamp (or other article) inserted into the carbon can be seen. Cutouts provided in selected panels of the foldable flap assembly automatically align with one another when the assembly snaps into its platform configuration and form a central aperture in the platform which is dimensioned to frictionally engage the based-end portion of the inserted electric lamp.

The unique platform-forming flap assembly of the present invention accordingly not only conserves packaging material and greatly facilitates the setting-up and loading of the carton but securely holds the inserted lamp in its loaded position within the carton and provides side windows for attractively displaying the packaged lamp to prospective purchasers.

BRIEF DESCRIPTION OF THE DRAWINGS

A better understanding of the invention will be obtained from the exemplary embodiments shown in the accompanying drawings, wherein.

DESCRIPTION OF THE PREFERRED EMBODIMENTS

While the present invention can be utilized to protectively package various kinds of fragile articles that have an enlarged body or bulbous portion and a constricted end portion, it is especially adapted for use in conjunction with the packaging of electric lamps which have such features and it has accordingly been so illustrated and will be so described.

Figure 1:
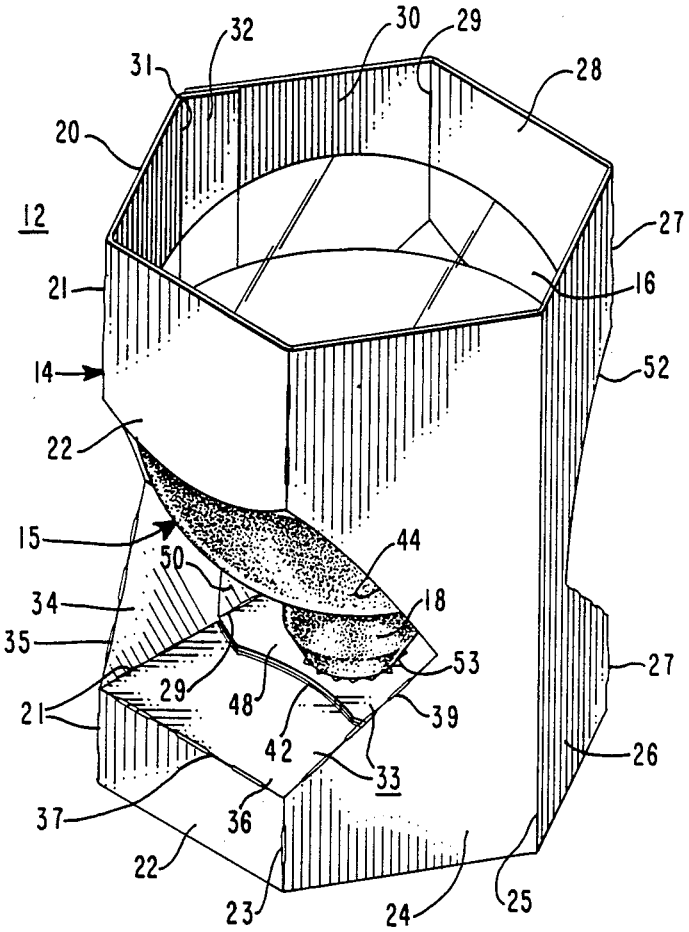
FIG. 1 is a perspective view of an improved electric lamp package according to the invention, the lamp in this particular embodiment comprising a reflector type incandescent lamp having a half-reflectorized spherical envelope.

As shown in FIG. 1, the novel packaging concept of the present invention provides a lamp package 12 that is very compact and attractive and consists of a carton 14 that is of tubular open-ended form and snugly encloses an electric lamp 15 of bulbous configuration. In this particular embodiment the lamp 15 has a spherical envelope 16 of glass that is half-reflectorized and terminated by a neck portion 19 and a base member 18 (not shown).

The carton 14 is fabricated from suitable paperboard that is rigid but readily foldable when properly scored. For this particular application boxboard has proven very satisfactory and a machine clay-coated newsboard or its equivalent is preferred. As will be noted, the carton has six walls 20, 22, 24, 26, 28 and 30 which are of the same size and shape and are hingedly connected to one another along hinge lines 21, 23, 25, 27, 29 and 31—thus forming a sleeve that is of hexagonal cross-section and open at both ends. The sleeve is fabricated from a single piece of packaging material, as described in detail hereinafter, and is held in tubular form by a tab 32 that is glued or otherwise fastened to the wall 30, tab 32 in turn being hingedly connected to the adjacent wall 20 along hinge line 31. The internal dimensions of the hexagonal sleeve-carton 14 are such that the walls engage and snugly embrace the spherical envelope 16 of the lamp 15 and thus frictionally hold the lamp in nested and recessed position within the carton.

To ensure that the electric lamp 15 does not slip out of the carton 14 while the package 12 is being handled, the constricted basal end portion of the lamp is inserted into and frictionally gripped by an apertured platform 33 that laterally extends the interior of the sleeve and is formed by a foldable flap assembly which is automatically actuated when the sleeve is expanded from collapsed condition to fully-erected form, as hereinafter explained. The foldable flap assembly which forms the platform 33 is fabricated from portions of the sleeve walls that are so cut, scored and interconnected that the various panels of the assembly automatically "snap" into the desired platform configuration just as the carton 14 reaches its fully-expanded and erected position. The platform 33 accordingly locks the carton 14 in its tubular configuration and the openings left in the sides of the sleeve by the displaced flap assembly provide a pair of windows 44, 52 which attractively display the electric lamp 15. The platform-forming flap assembly consists of two main panels 36, 48 that are hingedly connected to oppositely-disposed walls 22, 28 of the sleeve and overlap one another to form the transverse wall portion or "floor" of the platform 33 which serves as a rigidifying brace for the erected carton 14. The overlapped main panels 36, 48 are hingedly secured to the adjacent walls of the sleeve by two pairs of gussets that extend upwardly in flared-out fashion from the flat "floor" portion of the platform 33. Only two of these gussets (elements 34 and 50) are visible in the perspective view of the carton 14 and lamp package 12 shown in FIG. 1.

A clearer understanding of the structural features of the foldable platform-forming flap assembly and the manner in which it is formed from integral parts of opposing pairs of the walls of the carton 14 will be obtained from the plan view of the blank 11 (shown in FIG. 2) from which the carton is formed. As illustrated, the blank 11 consists of a rectangular piece of boxboard or the like that is divided into six wall-forming segments 20, 22, 24, 26, 28 and 30 by main score lines 21, 23, 25, 27, and 29 that are parallel to one another and extend across the blank. The blank 11 is folded along these score lines to form an open-ended sleeve that is collapsible so that it can be bulk-shipped to the lamp factory and subsequently expanded into a tubular carton of hexagonal configuration. The blank 11 is held in assembled form by a glue tab 32 that is hinged to wall segment 20 by another main score line 31 and secured to wall segment 30 which constitutes the other end of the blank. To facilitate setting up the sleeve into erect tubular form, main score lines 21, 23, 27 and 29 are perforated score lines and the remaining main scores 25 and 31 are continuous-cut score lines (that is, the boxboard material is partly cut through along the entire length of the score). Hence, when the sleeve that is formed by the assembled blank 11 is in collapsed or "flat" condition the blank, in effect, is folded upon itself along the continuous-cut main score lines 25 and 31 and such score lines thus constitute the side edges of the collapsed carton. The walls are accordingly arranged in oppositely-disposed pairs (walls 24 and 26, walls 22 and 28, and walls 20 and 30) that are in overlapping relationship.

The various panels for the platform-forming flap assembly are coined from medial portions of each of the aforementioned three sets of oppositely-disposed pairs of sleeve walls. A medial portion of wall 22 is accordingly divided into three panels 36, 40 and 42 by transverse auxiliary score lines 37, 41 and 43 that are solid score lines (not cut or perforated) and extend at right angles to and connect with the main score lines 21, 23. Panel 36 constitutes a main panel that is foldable along score line 37 and is joined to each of the adjacent walls 20, 24 by a pair of gusset panels 34, 38 that are foldable along another set of auxiliary score lines 35, 39 which extend in angular fashion toward the cutout portion of the blank 11 which defines the window opening 44. Panels 40 and 42 are not joined to the gussets 34 and 38 and thus constitute a mobile dual-segment tab assembly which has a central opening 45 that is bisected by the score line 43 that joins the two segments.

The other part of the foldable flap assembly consists of a single panel 48 that is formed from the medial part of wall 28 and constitutes a second main panel that is foldable along another transvese auxiliary score line 49 that extends at right angles to and joins the associated main score lines 27, 29. Main panel 48 is also joined to each of its adjacent walls 26, 30 by a second pair of gussets 46, 50 that are foldable along angularly-oriented auxiliary score lines 47 and 51 which terminate at another cutout that forms the other display window 52. Panel 48 is provided with an opening 53 of the same size and shape as opening 45 provided in panels 40, 42.

Figure 2:
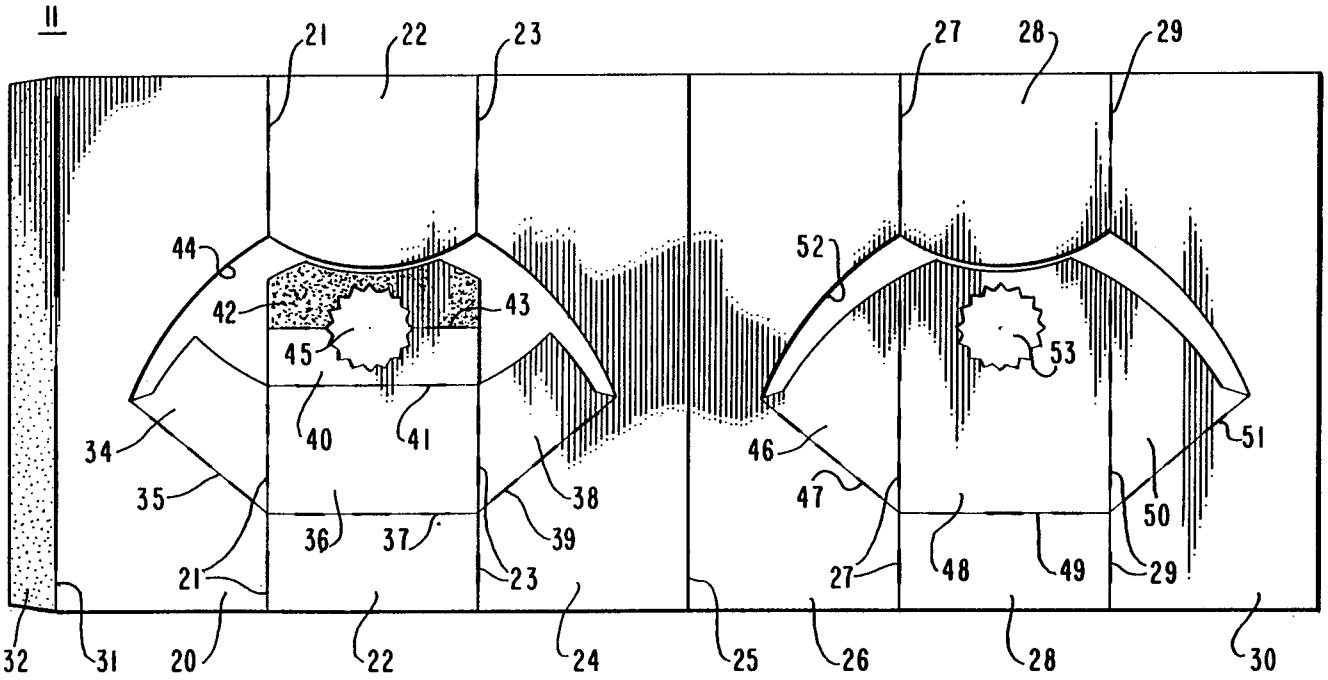
FIG. 2 is a plan view of the blank from which the carton shown in FIG. 1 is formed.

When the blank 11 is assembled into collapsible sleeve form, panel 42 is secured (by glue for example, as indicated by the stippling of panel 42 in FIG. 2) to the matching apertured end portion of main panel 48. The two groups of hinged panels and gussets that are coined from the oppositely-disposed pairs of the wall segments of the blank are accordingly interconnected, when the blank is glued and made into a sleeve, and form a unitary foldable assembly that is not only automatically actuated when the sleeve is expanded into tubular configuration but, by virtue of a toggle-like joint and hinge action produced by the various articulated panels, also automatically "snaps" into the desired platform position.

The relationship of the various panels of the flap assembly when the carton 14 is in its fully-erected position and locked in this configuration by the platform 33 then formed by the flap assembly is shown in the views of the lamp package 12 and carton 14 depicted in FIGS. 3–6.

Figure 3:
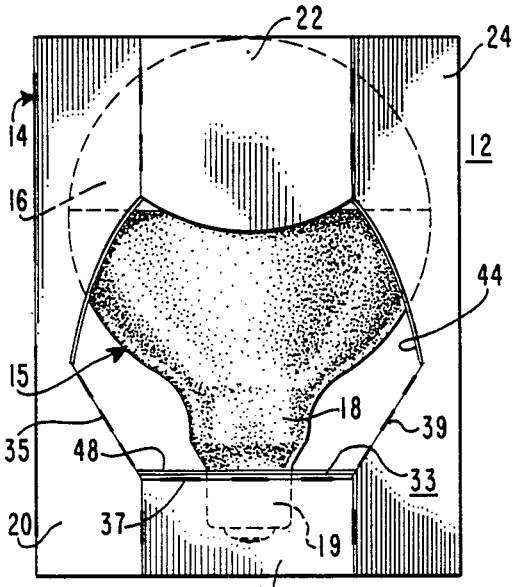
FIG. 3 is a front elevational view of the lamp package shown in FIG. 1.
Figure 4:
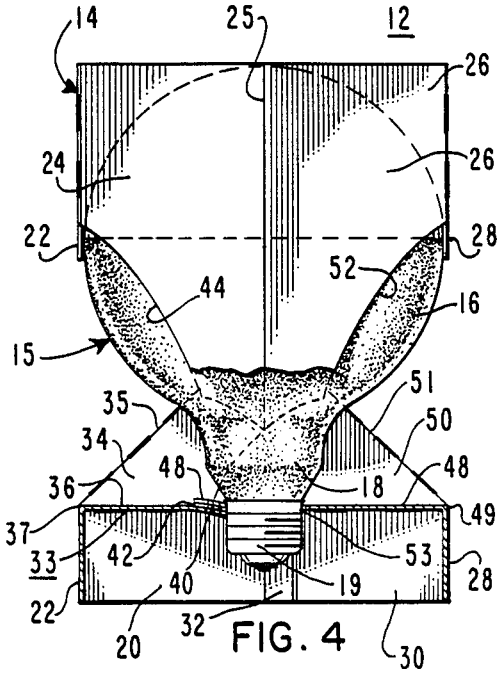
FIG. 4 is a side elevational view of the lamp package, portions of the carton being removed and shown in cross-section to illustrate structural features of the locking-platform.

As will be noted in FIG. 3, the reflectorized bottom portion of the spherical lamp 15 is visible through one of the display windows 44 provided by the snap-inturned flap assembly and the platform 33 is substantially flat and located a sufficient distance inwardly from the open end of the carton 14 to insure that the base member 19 on the neck portion 18 of the lamp envelope 16 is recessed within the carton and thus protected from damage. These features are shown in even greater detail in FIG. 4. The manner in which the walls of the carton 14 snugly embrace and grip the spherical lamp envelope 16 and still provide side windows 44, 52 that attractively display the bottom portion of the electric lamp 15 is also illustrated in FIG. 4. Also shown in the manner in which the apertured end portion of main panel 48 overlaps the folded panels 40 and 42 and is aligned with the other main panel 36 to form the "floor" of the platform 33 which extends across the bottom of the carton 14. The tight frictional fit between the lamp base 19 and aperture 53 in the platform 33 which securely holds the electric lamp 15 in its inserted position within the carton 14 and the manner in which the gussets 34, 50 extend upwardly from the platform are also shown in FIG. 4.

Figure 5:
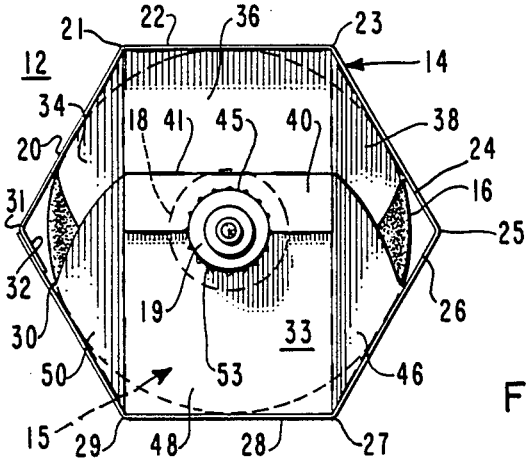
FIG. 5 is a bottom plan view of the lamp package.

The bottom view of the lamp package 12 shown in FIG. 5 illustrates the manner in which the overlapping apertured portions of the panels of the flap assembly automatically align with one another to permit the apertures 45, 53 to form a single aperture for frictionally engaging the base 19 of the inserted lamp 15. As shown, the semi-circular aperture 45 formed by the folded-over panels 40 and 42 coincides with the circular aperture 53 in main panel 48 to form a single opening for the lamp base. In order to enhance the base-gripping action, both of the apertures 45 and 53 have a sawtooth or ribbed profile rather than one which provides a smooth arcuate edge. The manner in which the paired gussets 34, 38 and 46, 50 seat against one another to form flared skirt-like walls that hold the platform 33 in place within the carton 14 is also clearly shown in FIG. 5.

Figure 6:
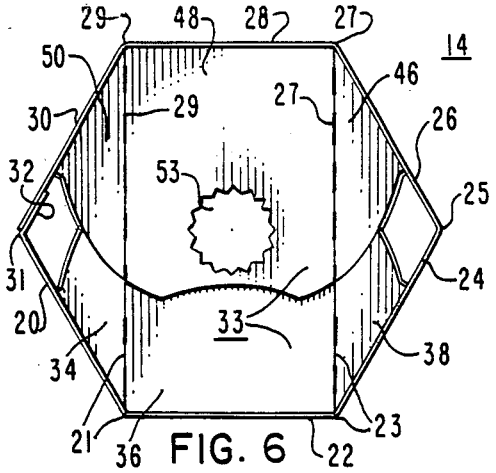
FIG. 6 is a top plan view of the erected carton shown in FIG. 1, the electric lamp being omitted to afford a full view of the locking-platform.

The structural interaction of the gussets and platform is illustrated in even greater detail in the top view of the empty carton 14 shown in FIG. 6. As will be noted, the arcuate ends of the gussets 34, 38, 46 and 50 are cut with the same radii of curvature and thus smoothly interfit with one another and provide a pair of sloped internal walls when the carton 14 is set up for loading and the gussets are inturned toward each other. FIG. 6 also illustrates the manner in which the perforated score lines 21–29 and 23–27 are aligned with one another when the flap assembly is locked in place and forms the apertured platform 33.

Figure 8:
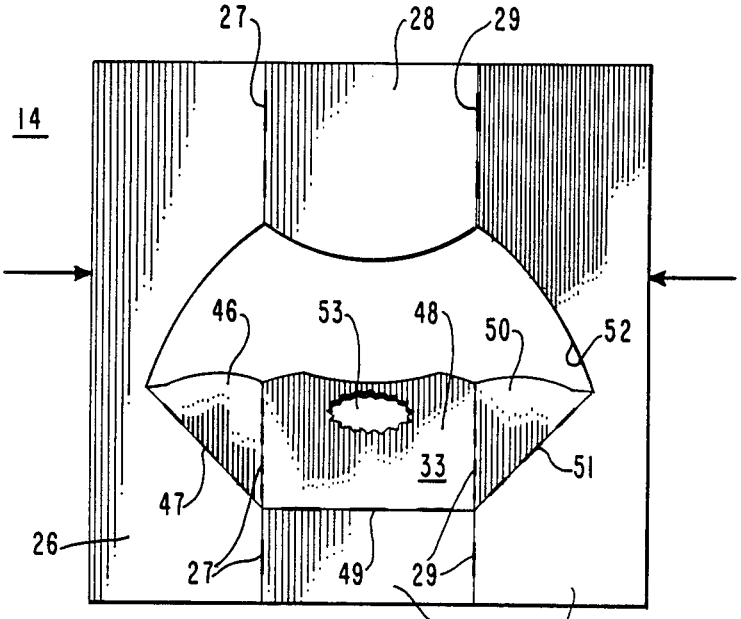
FIGS. 7 and 8 are front and rear elevational views, respectively, of the carton during the initial phase of the setting-up operation when the carton is in partially-expanded condition.
Figure 7:
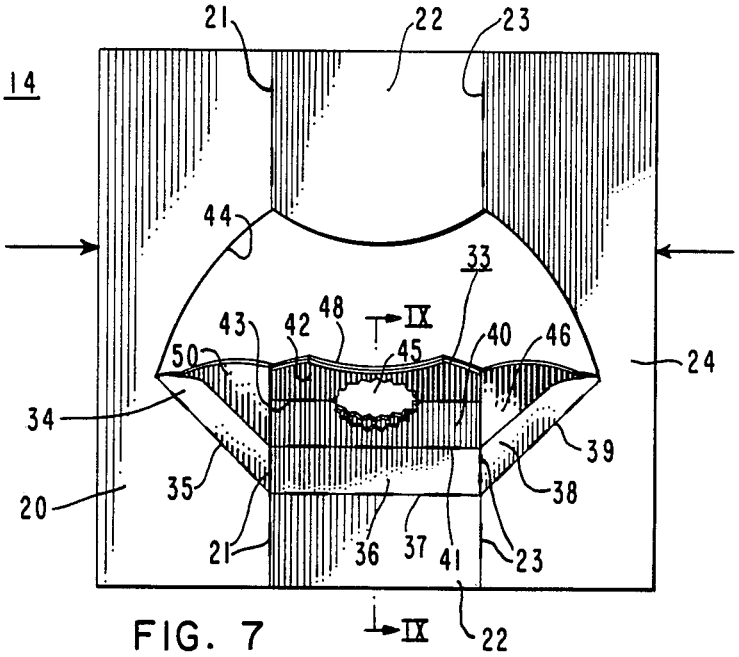
Figure 9:
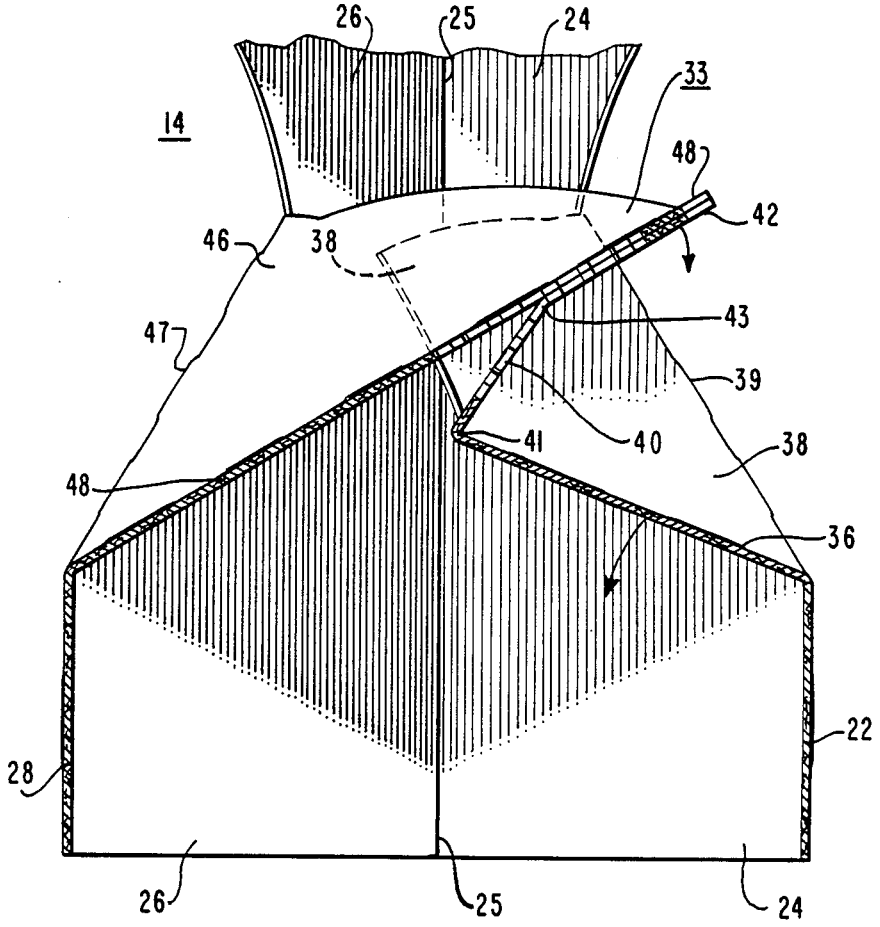
FIG. 9 is an enlarged cross-sectional view through the platform-forming portion of the partially expanded carton, taken along line IX—IX of FIG. 7.

The toggle-like joint and snap-locking action provided by the articulated panels which comprise the foldable flap assembly are shown in FIGS. 7–9 and will now be described. The carton 14 is shown in partly expanded condition in each of these Figures and, as indicated by the arrows in FIGS. 7 and 8, erection of the carton into tubular sleeve form is achieved by applying pressure to the side edges of the collapsed carton. As will be noted in FIG. 7, the pivotal movement of the walls of the carton 14 and the flap assembly produced as the carton is being set up for loading automatically causes gussets 34 and 38 to swing inwardly into the carton along with main panel 36, thus causing panels 40 and 42 that are fastened to the other main panel 48 to pull panel 48 downwardly toward panel 36 as the latter swings from upstanding to laterally extending position. As panel 48 moves downwardly, its hingedly-attached gussets 46 and 50 also swing in the same direction toward the other pair of gussets 34, 39. This downward movement of main panel 48 and its gussets 46, 50 is shown in greater detail in the opposite side view of the partly expanded carton 14 shown in FIG. 8.

The "toggle-like" joint and resulting snap-locking action which converts the flap assembly into a laterally-extending platform is illustrated in the enlarged sectional view of the partly expanded carton 14 shown in FIG. 9. As indicated by the arrows, when the main panel 36 is automatically pulled downwardly by the expansion of the collapsed carton 14, score lines 41 and 43 and the associated panels 40, 42 coact to provide a toggle-like hinging action which exerts a downward pull on the other main panel 48 (and its attached gussets 46, 50) so that the apertured end of main panel 48 swings into overlapping relationship with panel 40 and coplanar relationship with main panel 36. The stiffness of the boxboard from which the carton 14 is made and the pivotal interaction of the various hinged panels are such that the forces which act on the aforementioned panels of the flap assembly and actuate the toggle-like joint progressively increase as the collapsed carton is further expanded and finally reach a level that causes the flap assembly to snap into its platform configuration just as the carton reaches its fully expanded configuration. The resulting bracing and rigidifying structure produced by the snap-inturned platform 33 locks the carton 14 in its fully expanded and erected condition and thus sets it up for loading with very little effort on the part of the factory worker.

Figure 10:
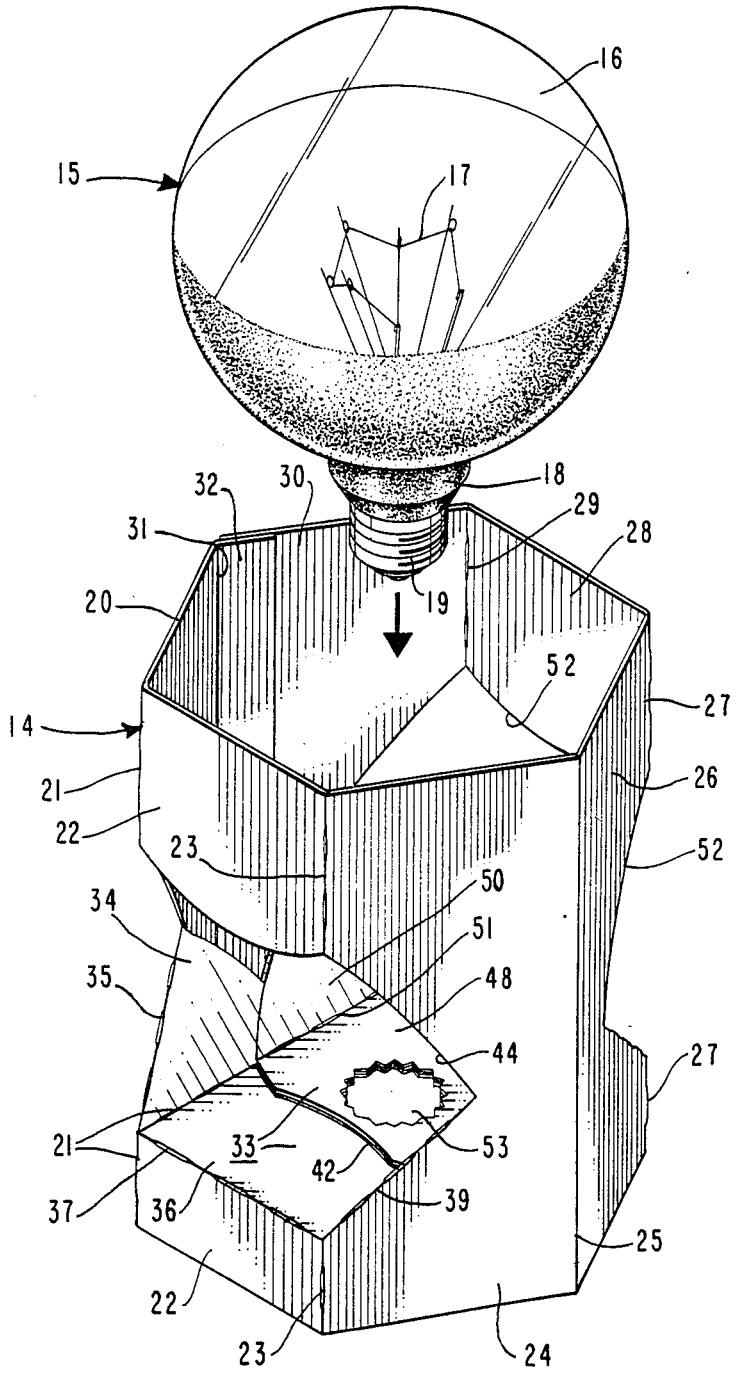
FIG. 10 is an exploded perspective view illustrating the manner in which the spherical reflector type incandescent lamp is inserted into the fully-erected carton to form the lamp package shown in FIG. 1.

The lamp-loading operation is shown in FIG. 10 and, as indicated by the arrow, is accomplished by inserting the basal end portion of the electric lamp 15 into the erected carbon 14 so that the lamp base 19 will enter and be pushed into the ribbed-aperture 53 in the platform 33. In this particular embodiment the spherical envelope 16 of the lamp contains a suitable filament 17 which is located in proper relationship with the refectorized portion of the envelope.

ALTERNATIVE EMBODIMENT (FIG. 11)

Figure 11:
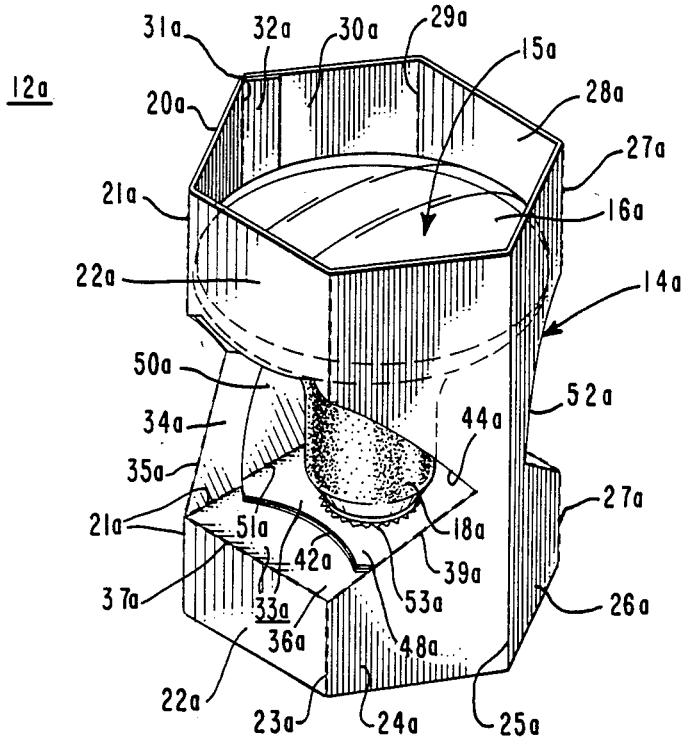
FIG. 11 is a perspective view of an alternative lamp package that contains a reflector lamp that has a paraboloidal-shaped envelope rather than one which is spherical.

The invention is not limited to packaging electric lamps of spherical configuration but can be used for packaging electric lamps that have envelopes which are generally pear-shaped or of paraboloidal configuration. A package **12*a* which comprises a carton 14*a* constructed in accordance with the present invention and containing a reflector-type incandescent lamp 15*a* of smaller size that has a paraboloidal envelope is shown in FIG. 11. As indicated by the matching reference numerals for the various parts of the carton 12*a*, its construction is identical to the carton previously described except that its dimensions are modified to permit the six walls 20***a*, 22*a*, 24*a*, 26*a*, 28*a* and 30*a* to snugly embrace and grip the paraboloidal glass envelope 16*a* at its maximum dimension. The length of the carton 12*a* and the position of the platform 33*a* formed by the snap-locked flap assembly are such that the reflector lamp 15*a* is recessed within the carton and thus protected from damage even though it is visible through the side window-openings 44*a*, 52*a* and the open ends of the carton.

We claim:

1. A carton for packaging and displaying a bulbous-shaped electric lamp or similar fragile article comprising:

a paperboard sleeve that is open at both ends and has six walls that are hingedly connected to one another, said walls being of such size and shape that the sleeve can be collapsed and then erected into hexagonal tubular form, and automatically actuated locking means automatically actuated when the sleeve is erected for locking the sleeve in such erected tubular form and for holding an electric lamp or similar article in inserted position within the carton, said automatically actuated locking means comprising a foldable flap assembly having a plurality of panels that constitute parts of opposing walls of the sleeve secured to one another and are so shaped and articulated that the flap assembly is automatically actuated when the sleeve is erected and forms a platform that extends across the sleeve proximate one end thereof locking the sleeve in its fully erected configuration and has an aperture adapted to receive and frictionally grip an end portion of the inserted electric lamp or similar article, and the various panels of the flap assembly when displaced from the associated walls of the erected sleeve into locking position across the sleeve leaving openings in the sides of the carton that serve as product-display windows, wherein the six walls which form the collapsible open-ended sleeve are of substantially the same size and are arranged that three walls overlie and are substantially aligned with the other three walls when the sleeve is in collapsed condition, and the panels which form said flap assembly comprise medial parts of the associated oppositely-disposed walls, said flap assembly comprising a first group of panels that constitute connected medial parts of oppositely-disposed walls of the sleeve and are foldable along hinge lines that extend transversely of the hinge lines that connect the respective walls to one another, and a second group of panels that also constitute medial parts of said oppositely-disposed walls of the sleeve but are foldable along hinge lines that are angularly oriented relative to the hinge lines that connect the respective walls to one another, said second group of panels constituting two pairs of gussets that are connected to the first group of panels and fold inwardly toward one another when the sleeve is being erected, and wherein the hinge lines that join the six walls of the sleeve to one another are substantially straight and substantially parallel to one another, and the first group of panels comprising (a) a first main panel that constitutes a medial part of one of the sleeve walls and is foldable along the two parallel-spaced hinge lines that join said one wall to the adjacent walls of the sleeve and along a third hinge line that is substantially normal to and extends between the said two parallel-spaced hinge lines, and (b) three panels that together constitute a medial part of the oppositely-disposed wall of the sleeve and are foldable along three hinge lines that are substantially parallel to one another and substantially normal to the parallel-spaced hinge lines that join said oppositely-disposed wall to the adjacent sleeve walls, only one of the said three panels being connected to the adjacent sleeve walls by the parallel-spaced hinge lines which join said oppositely-disposed wall to said adjacent sleeve walls and constituting a second main panel, the remaining two panels being freely movable and constituting a dual-segment tabuluar extension, and the panel which comprises the free end of said tabular extension being fastened to the end portion of the first main panel that constitutes part of the oppositely-disposed wall of the sleeve and thereby provides a joint which causes the integral foldable flap assembly to be automatically actuated and locked in platform-forming position when the sleeve is erected into tubular form.

2. The carton of claim 1 wherein;

the end portion of said first main panel that is fastened to the tabular extension has an article-receiving aperture therein, and the two panels which constitute the tabular extension has a matching article-receiving aperture therein that is bisected by the hinge line that joins said two panels, the toggle-joint and resulting snap-locking action of the platform-forming flap assembly being such that the two panels of the tabular extension are folded into overlapping relationship with one another and with the fastened end portion of said first main panel when the sleeve is in fully-erected tubular configuration, the article-receiving apertures in the overlapped portions of the flap assembly being so oriented that the apertures are substantially aligned and form a single aperture even though the two panels of the tabular extension are overlapped.

3. The carton of claim 2 wherein the two pairs of gusset-panels are hingedly connected to the first and second main panels of the flap assembly that are hinged to the walls of the sleeve, one of said gusset-panels being disposed at and extending from each side of the associated main panels.

4. The carton of claim 3 wherein the sleeve is formed from a unitary blank of foldable paperboard.

5. The carton of claim 4 wherein;

the unitary blank is fabricated from boxboard and provided with a hinged tab at one end that is glued to the other end of the blank and holds the blank in collapsible sleeve form, and the end panel of the foldable tabular extension is fastened in overlapped relationship with the end portion of said first main panel by an adhesive.

6. The carton of claim 5 wherein;

the hinge lines that connect the main panels of the foldable flap assembly to the associated walls of the sleeve and the gusset-panels comprise perforated scores in the boxboard blank, the hinge lines that connect the gusset-panels to the associated walls of the sleeve also comprise perforated scores in the boxboard blank, the hinge lines that connect the two panels of the tabular extension to each other and to the second main panel comprise solid scores in the boxboard blank, and the hinge lines that connects the glue tab to the associated sleeve wall and the hinge line which bisects the blank and thus extend along the side edges of the collapsed sleeve both comprise continuous-cut scores in the boxboard blank.

7. A package comprising the combination of:

the open-ended hexagonal sleeve-like carton of claim 1, 2, 3, 4, 5 or 6 in erected tubular condition, and a bulbous-shaped fragile article comprising an electric lamp or the like disposed within the carton and having a constricted end portion that is inserted into and is in frictional engagement with the aperture in the snap-locked platform formed by the foldable flap assembly of the carton, the size and shape of the bulbous part of the article relative to the internal dimensions of the hexagonal carton being such that the walls of the carton snugly embrace and grip said bulbous part and thus assist the apertured platform in retaining the article in loaded position within the carton.

8. A collapsible tubular carton, comprising:

a plurality of panels hinged together along adjacent panel edges for permitting the carton to be collapsed flat with each panel confronting an opposite panel and for permitting the carton to be expanded to a tubular shape with pairs of opposed panels spaced away from each other;

one of said panels having a hinged flap defined by a medial portion of said one panel section hinged along a hinge line transverse to the edges of said one panel and pivotable toward the opposite panel corresponding to said one panel;

said corresponding panel opposite said one panel having a hinged flap defined by a medial portion of said corresponding panel hinged along three hinge lines transverse to the edges of said corresponding panel to define three hinged flap portions, a first flap portion furthest from said corresponding panel, a second flap portion and a third flap portion adjacent said corresponding panel; and means for fastening said first flap portion to said flap of said one panel at a position along said flap of said one panel such that the tubular carton will lie flat in a collapsed condition with said first, second and third flap portions flat against said flap of said one panel;

said second and third flap portions together having a total length such that said second and third flap portions lie substantially coplanar extending from the hinge line between said first and second flap portions back to said corresponding panel when the carton is expanded to a tubular shape and said flap of said one panel is folded inwardly of the carton to lie transverse to the carton; and said second and third flap portions having relative lengths such that as the carton is expanded from its collapsed condition to its tubular condition said flap of said one panel and said second and third flap portions of said corresponding panel pull away from each other with said second and third flap portions pivoting relative to each other, said third flap portion pulling said second flap portion away from said flap of said one panel until said second flap portion folds back toward said first flap portion so as to lie against said first flap portion and coplanar with said third flap portion when the carton is fully expanded.

9. A collapsible tubular carton according to claim 8, comprising six panels hinged together to define a hexagonal tubular carton.

10. A collapsible tubular carton according to claim 8, wherein said means for fastening said first flap portion to said flap of said one panel is a permanent adhesive.

11. A collapsible tubular carton according to claim 8, wherein said flap of said one panel, and said first and second flap portions, have respective apertures in registration when the tubular carton is expanded and the hinged flaps of said one panel and said corresponding panel are fully extended for receiving and holding a portion of an article held within the carton.

* * * * *